US011313166B2

(12) United States Patent
Kalb et al.

(10) Patent No.: US 11,313,166 B2
(45) Date of Patent: Apr. 26, 2022

(54) DRIVE DEVICE FOR A WINDOW REGULATOR

(71) Applicant: BROSE FAHRZEUGTEILE GMBH & CO. KOMMANDITGESELLSCHAFT, BAMBERG, Bamberg (DE)

(72) Inventors: Roland Kalb, Rossach (DE); Gabriele Lange, Marktrodach (DE)

(73) Assignee: Brose Fahrzeugteile GmbH & Co. Kommanditgesellschaft, Bamberg, Bamberg (DE)

( * ) Notice: Subject to any disclaimer, the term of this patent is extended or adjusted under 35 U.S.C. 154(b) by 335 days.

(21) Appl. No.: 16/331,058

(22) PCT Filed: Sep. 5, 2017

(86) PCT No.: PCT/EP2017/072229
§ 371 (c)(1),
(2) Date: Mar. 6, 2019

(87) PCT Pub. No.: WO2018/046491
PCT Pub. Date: Mar. 15, 2018

(65) Prior Publication Data

US 2019/0203518 A1 Jul. 4, 2019

(30) Foreign Application Priority Data

Sep. 6, 2016 (DE) ..... 102016216876.2

(51) Int. Cl.
*E05F 11/48* (2006.01)
*E05F 15/697* (2015.01)

(52) U.S. Cl.
CPC ..... *E05F 15/697* (2015.01); *E05F 11/483* (2013.01); *E05Y 2201/664* (2013.01); *E05Y 2600/51* (2013.01)

(58) Field of Classification Search
CPC ..... E05F 15/697; E05F 11/483; E05Y 2201/664; E05Y 2201/628; E05Y 2600/51; E05Y 2900/55
(Continued)

(56) References Cited

U.S. PATENT DOCUMENTS 4,471,251 A * 9/1984 Yamashita ..... B60J 5/0405 296/146.2
4,970,911 A * 11/1990 Ujihara ..... E05F 11/486 74/501.5 R (Continued)

FOREIGN PATENT DOCUMENTS

CN 1347476 A 5/2002
CN 102834577 A 12/2012

(Continued)

*Primary Examiner* — Jerry E Redman
(74) *Attorney, Agent, or Firm* — Brooks Kushman, P.C.

(57) ABSTRACT

It is provided a drive device for an adjustment installation for adjusting a vehicle part, in particular a power window actuator, comprising a carrier element, a cable drum, a cable exit housing which is disposed on a first side of the carrier element and which has a first bearing element for mounting the cable drum so as to be rotatable about a first rotation axis, a drive wheel that is drivable by a motor unit, and a drive housing which is disposed on a second side, facing away from the first side, of the carrier element and which has a second bearing element for mounting the drive wheel so as to be rotatable about a second rotation axis. The cable exit housing and the drive housing are fastened to one another by way of a fastening element which acts between the first bearing element and the second bearing element.

11 Claims, 9 Drawing Sheets

(58) Field of Classification Search
USPC ..... 49/352
See application file for complete search history.

(56) References Cited

U.S. PATENT DOCUMENTS

| | | | | |
|---|---|---|---|---|
| 5,207,393 | A * | 5/1993 | Marscholl | E05F 15/697 242/396.2 |
| 5,890,321 | A * | 4/1999 | Staser | E05F 15/697 49/502 |
| 6,185,873 | B1 * | 2/2001 | Saito | E05F 15/697 49/348 |
| 6,305,129 | B1 * | 10/2001 | Eckhardt | B60J 5/0416 296/146.7 |
| 6,427,386 | B1 * | 8/2002 | Kalb | H02K 7/1166 49/349 |
| 6,574,922 | B2 * | 6/2003 | Velthaus | E05F 15/689 296/146.7 |
| 6,629,905 | B1 * | 10/2003 | Sesselmann | E05F 11/483 254/344 |
| 7,044,412 | B2 * | 5/2006 | Hemond | E05F 11/483 242/390.8 |
| 7,591,104 | B2 * | 9/2009 | Takeda | B60J 5/0416 49/352 |
| 7,627,989 | B2 * | 12/2009 | Ootsuki | E05F 15/689 49/349 |
| 7,823,329 | B2 * | 11/2010 | Stahn | E05F 11/48 49/352 |
| 10,895,097 | B2 * | 1/2021 | Arimoto | H02K 5/22 |
| 2001/0034975 | A1 * | 11/2001 | Dobson | E05F 15/689 49/352 |
| 2002/0007596 | A1 * | 1/2002 | Cabanne | E05F 15/697 49/352 |
| 2005/0016069 | A1 * | 1/2005 | Doux | E05F 15/697 49/352 |
| 2006/0105877 | A1 | 5/2006 | Bornchen et al. | |
| 2006/0130405 | A1 * | 6/2006 | Hemond | E05F 15/697 49/352 |
| 2007/0017159 | A1 * | 1/2007 | Moore | B60J 5/0416 49/502 |
| 2008/0263959 | A1 * | 10/2008 | Brauer | E05F 11/483 49/349 |
| 2019/0048641 | A1 * | 2/2019 | Muramatsu | B60J 1/17 |
| 2019/0203519 | A1 * | 7/2019 | Kalb | E05F 15/689 |

FOREIGN PATENT DOCUMENTS

| | | | |
|---|---|---|---|
| DE | 102004044863 | A1 | 3/2006 |
| EP | 1231350 | A2 | 8/2002 |
| JP | 2001311373 | A | 11/2001 |
| KR | 20130073580 | A | 7/2013 |
| WO | 9947779 | A2 | 9/1999 |

* cited by examiner 1
2
3
4
6
7
20
21
22
30
31
32
40
42
45
46
61
202
210
211
220
221
420
720
722
X1
X2
D 1
2
3
4
6
7
20
21
22
31
32
40
42
46
61
202
210
211
220
420
720
722
D
X3

DRIVE DEVICE FOR A WINDOW REGULATOR

CROSS-REFERENCE TO RELATED APPLICATIONS

This application is the U.S. National Phase of PCT Application No. PCT/EP2017/072229, filed on Sep. 5, 2017, which claims priority to German Patent Application No. 10 2016 216 876.2, filed on Sep. 6, 2016, the disclosures of which are incorporated in their entirety by reference herein.

TECHNICAL FIELD

The disclosure relates to a drive device for an adjustment installation for adjusting a vehicle part, in particular a power window actuator.

BACKGROUND

Vehicles may include one or more drive devices to adjust a vehicle part. A drive device of this type may include a carrier element, a cable drum, a cable exit housing which is disposed on a first side of the carrier element, a drive wheel that is drivable by a motor unit, and a drive housing which is disposed on a second side, facing away from the first side, of the carrier element. The cable exit housing has a first bearing element for mounting the cable drum so as to be rotatable about a first rotation axis. By contrast, the drive housing has a second bearing element for mounting the drive wheel so as to be rotatable about a second rotation axis.

A drive device of this type can in particular be a component part of a power window installation and can thus serve for adjusting a window glass. However, such a drive installation can also serve for adjusting another adjustment element, for example a sliding roof or the like, in a vehicle.

In the case of a power window actuator, one or a plurality of guide rails on which one entrainment element that is coupled to a window glass is in each case guided can be disposed in an apparatus carrier of a door module, for example. The entrainment element is coupled to the drive device by way of a flexurally limp traction cable which is conceived for transmitting (exclusively) tensile forces, wherein the traction cable is disposed on the cable drum in such a manner that the traction cable, in a rotating movement of the cable drum, by way of one end is wound onto the cable drum and by way of another end is unwound from the cable drum. A displacement of a cable loop formed by the traction cable thus takes place in a manner corresponding to a movement of the entrainment element along the respectively assigned guide rail. The window glass, driven by the drive device, can thus be adjusted so as to release or close a window opening on a door on the side of a vehicle, for example.

SUMMARY

It is an object underlying the proposed solution to make available a drive device which is particularly simple to assemble and when in operation can have a favorable operational behavior.

This object is achieved by a subject matter having features as described herein.

Accordingly, the cable exit housing and the drive housing are fastened to one another by way of a fastening element which acts between the first bearing element and the second bearing element.

The first bearing element of the cable exit housing on which the cable drum is rotatably mounted, and the second bearing element of the drive housing on which the drive wheel is rotatably mounted, herein can be disposed so as to be mutually coaxial in such a manner that the first rotation axis (of the first bearing element) and the second rotation axis (of the second bearing element) are mutually aligned.

A very simple assembly results on account of the cable exit housing on the first side of the carrier element, and the drive housing on the other, second side of the carrier element, being fastened to one another and therefore being established on the carrier element by way of a (single) fastening element which acts between the first bearing element and the second bearing element. For assembly, the cable exit housing, on the one hand, and the drive housing, on the other hand, can in particular be attached to the carrier element so as to thereafter connect the cable exit housing and the drive housing to one another, mutually brace in an axial manner said cable exit housing and said drive housing, by way of the fastening element, for example a screw element.

The fastening element herein can engage from one of the bearing elements in the other of the bearing elements and, on account thereof, connect the bearing elements to one another. The cable exit housing, on the one hand, and the drive housing, on the other hand, are thus mutually established by way of the bearing elements.

For example, in the case of an arrangement according to the intended use on a vehicle, the cable drum is disposed on a door on the side of the vehicle, for example in a wet space, while the motor unit of the drive device lies in a dry space. The separation between the wet space and the dry space herein can be provided by the carrier element, for example an apparatus carrier, made of plastics, of a door module. Such a wet space/dry space separation can be maintained in a simple manner on account of the assembly of the cable exit housing on the one side of the carrier element and of the drive housing on the other side of the carrier element, and on account of the connection by way of a (single) central fastening element, without said wet space/dry space separation being compromised by fastening elements that engage from one side to the other.

The first bearing element serves for mounting the cable drum and to this end can for example be configured as a cylindrical bearing dome which projects from a base of the cable exit housing. Moreover, the second bearing element of the drive housing, which serves for mounting the drive wheel on the side of the carrier element that faces away from the cable drum, can be configured as a cylindrical bearing dome on the drive housing. The bearing domes are axially mutually braced by way of the fastening element, such that the cable exit housing, on the one hand, and the drive housing, on the other hand, are established on the carrier element by way of said bracing.

In order to ensure that the first bearing element of the cable exit housing and the second bearing element of the drive housing are attached to one another in a positionally correct manner when assembling, one of the bearing elements may have a conical portion (a so-called centering cone) while the other bearing element has a centering engagement which can be configured, for example, by a conical opening. When the cable exit housing is attached to the carrier element, on the one hand, and the drive housing is attached to the carrier element, on the other hand, the conical portion and the entering engagement come to mutually engage such that the first bearing element of the cable exit housing and the second bearing element of the drive housing are mutually centered and it is ensured that the first rotation axis (of the first bearing element of the cable exit housing) and the second rotation axis (of the second bearing element of the drive housing) are aligned so as to be mutually coaxial.

In an embodiment, the center-aligning engagement between the conical portion, on the one hand, and the centering engagement, on the other hand, can be established only when bracing during the assembly, for example.

It can thus be provided that, in a first assembly position in which the cable exit housing and the drive housing are disposed on the carrier element but are not yet mutually axially braced by way of the fastening element, the conical portion and the centering engagement have mutual axial play. The conical portion and the centering engagement in the first assembly position thus do not directly bear on one another. Conical area portions of the conical portion, on the one hand, and of the centering engagement, on the other hand, have in particular not yet slid onto one another. On account of the axial play the first bearing element and the second bearing element are not (yet) axially supported on one another.

In a second assembly position (which corresponds to the function position according to the operation), in which the cable exit housing and the drive housing are mutually axially braced by way of the fastening element, the conical portion and the centering engagement do however bear on one another. The play between the first bearing element and the second bearing element, as existed in the first assembly position, is thus eliminated in the second assembly position. The first bearing element and the second bearing element are mutually centered on account of the conical portion and the centering engagement bearing on one another, such that it is ensured that the first rotation axis of the first bearing element and the second rotation axis of the second bearing element are aligned with one another in the proper manner.

In the bracing of the cable exit housing in relation to the drive housing by way of the fastening element that is configured as a screw element, for example, it can be provided that the cable exit housing is elastically deformed in one region or in a plurality of regions. Any play between the cable exit housing, the carrier element, and the drive housing, as well as any play in the mounting of the cable drum, can be equalized on account of such a deformation capability.

Such an elastic deformation capability can be made available by way of a targeted shaping on portions of the cable exit housing. Such an elastic deformation capability can be provided, for example, on the base of the cable exit housing from which the first bearing element projects. The base herein is connected to the carrier element for example by way of one or more housing portions which are radially spaced apart from the first bearing element, such that the base lies away from the carrier element and the cable drum is received within the cable exit housing.

One or a plurality of structural elements for reinforcing the base can be provided on the base, for example. Reinforcement ribs which extend radially in relation to the first rotation axis, or circumferentially about the first rotation axis, can thus be molded on the base. One or a plurality of said reinforcement ribs can be interrupted in portions, in that recesses are provided on the assigned reinforcement ribs, such that a material weakening which enables an (elastic) deformation of the base specifically at this location is achieved at said recesses in order for a predetermined breaking point to be achieved on the base herein.

The reinforcement ribs may be axially symmetrical in relation to the first rotation axis in that said reinforcement ribs extend radially in relation to the first rotation axis or extend circumferentially around the first rotation axis. The recesses may be axially symmetrical in relation to the first rotation axis in that said recesses are disposed along a circle about the first rotation axis, for example.

The axial play between the bearing elements when bracing the cable exit housing in relation to the drive housing can be elastically equalized by the predetermined breaking point (which corresponds to a predetermined deformation line about the first rotation axis, for example) achieved by way of the recesses.

Moreover, a base portion of the at least one housing portion can also be elastically deformable, for example, such that play in the bracing of the cable-exit housing in relation to the drive housing by way of the fastening element can also be equalized by an elastic deformation on such a base portion.

The cable exit housing and the drive housing, with the intervention of the carrier element, are axially mutually established by way of the fastening element which acts between the first bearing element of the cable exit housing and the second bearing element of the drive housing, and said cable exit housing and said drive housing are mutually fastened on the carrier element by bracing. Torques herein can act on the cable exit housing by way of the cable drum that is mounted on the first bearing element, while torques can also bear on the drive housing by way of the drive wheel that is mounted on the second bearing element. It is thus to be guaranteed that the cable exit housing, just like the drive housing, in the operation of the drive device cannot move in a rotating manner in relation to the carrier and in relation to one another. An anti-rotation safeguard is thus to be provided between the cable exit housing and the carrier element, on the one hand, and the drive housing and the carrier element, on the other hand.

To this end, the at least one housing portion by way of which the base of the cable exit housing is connected to the carrier element, can be established so as to be rotationally fixed on the carrier element, for example. A positive-lock element which in the case of an assembled cable exit housing by way of a positive-lock opening engages on the other respective component (thus the carrier element or the base portion of the at least one housing portion) can thus be provided on a base portion of the at least one housing portion or the carrier element. An anti-rotation safeguard between the cable exit housing and the carrier element is thus provided by way of the engagement of the positive-lock element in the positive-lock opening. The torques can thus be favorably absorbed on account of the at least one housing portion being radially spaced apart from the first bearing element and thus being rotatable about the cable drum radially outside the first rotation axis.

The cable exit housing by way of the at least one housing portion herein is axially supported on the carrier element and, by axially bracing the cable exit housing in relation to the drive housing, is also braced in relation to the carrier element. The tensioning force of the fastening element is supported on the carrier element by way of the at least one housing portion.

Alternatively or additionally, the drive housing can have at least one fastening installation, for example a fastening bush having a positive-lock opening molded therein, which is radially spaced apart from the second bearing element. The drive housing can also be established in a rotationally fixed manner on the carrier element by way of the fastening installation such that torques acting about the second rotation axis that is defined by the second bearing element can be absorbed and discharged and can in particular not lead to a rotation of the drive housing on the carrier element.

For securing the drive housing against rotation on the carrier element, a positive-lock element which is disposed on the carrier element or the fastening installation of the drive housing may engage in a positive-locking manner in a positive-lock opening which is formed on the respective other component (thus the fastening installation of the drive housing or the carrier element). Torques can be absorbed and discharged by way of the positive-locking engagement such that the drive housing is established in a rotationally fixed manner on the carrier element.

Both the cable exit housing as well as the drive housing can be secured in a positive-locking manner so as to be rotationally fixed on the carrier element. This positive lock is produced in a self-acting manner when attaching the cable exit housing to the first side of the carrier element and when attaching the drive housing to the second side of the carrier element, without separate assembly steps being required to this end and further fastening elements, for example in the form of screw elements, having to be fitted. The mutual (axial) establishing of the cable exit housing and of the drive housing may be performed solely by way of the fastening element that acts centrally between the bearing elements of the cable exit housing and the drive housing.

Damping elements which form an elastic damping intermediate layer between the positive-lock elements and the walls of the positive-lock openings can be disposed on the positive-lock elements. In this way, an acoustic decoupling between the drive housing and the carrier element can be achieved in operation.

BRIEF DESCRIPTION OF THE DRAWINGS

The concept on which the solution is based is to be explained in more detail hereunder by means of the exemplary embodiments illustrated in the figures.

DETAILED DESCRIPTION

Such a drive installation has generally to be designed so as to make available a torque of sufficient strength in order for the window glass to be adjusted. The drive device herein is to be able to have a small installation space, is to be easily assembled for example on an assigned carrier element, for example the apparatus carrier of a door module, and when in operation is to have a favorable operational behavior together with a low generation of noise, for example on a door module of a vehicle door.

In the case of a drive for an adjustment installation in a motor vehicle, known from DE 10 2004 044 863 A1, a cable drum is disposed on a bearing dome of a drive housing, wherein the drive housing by way of a fastening element in the form of a screw is connected to a carrier element in the form of an apparatus carrier.

FIGS. 1A, 1B to 9 show a first exemplary embodiment of a drive device 1 which can be used, for example, as a drive in an adjustment device for adjusting a window glass, for example of a side door of a vehicle.

Figure 12:
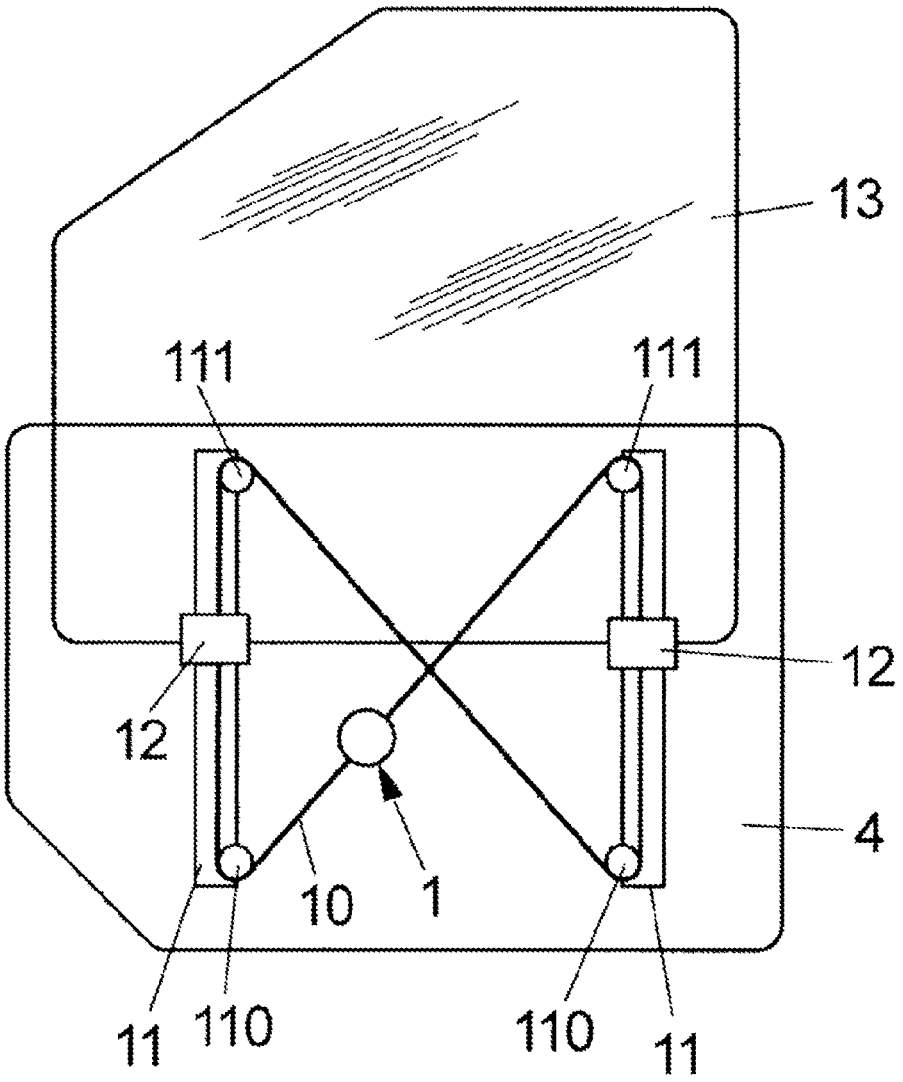
FIG. 12 shows a schematic view of an adjustment installation of a vehicle in the form of a power window actuator.

Such an adjustment device in the form of a power window actuator, illustrated in an exemplary manner in FIG. 12, has a pair of guide rails 11, for example, on which one entrainment element 12 which is coupled to a window glass 13 is in each case adjustable. Each entrainment element 12 is coupled to a drive device 1 by way of a traction cable 10 which is configured for transmitting (exclusively) tensile forces, wherein the traction cable 10 configures a closed cable loop and to this end, by way of the ends of said traction cable 10, is connected to a cable drum 3 (cf. FIGS. 1A and 1B, for example) of the drive device 1. The traction cable 10 extends from the drive device 1 around deflection rollers 110 on the lower ends of the guide rails 11 to the entrainment elements 12, and from the entrainment elements 12 around deflection rollers 111 at the upper ends of the guide rails 11 back to the drive device 10.

When in operation, a motor unit of the drive device 1 drives the cable drum 3 in such a manner that the traction cable 10 by way of one end is wound onto the cable drum 3, and by way of the other end is unwound from the cable drum 3. On account thereof, the cable loop formed by the traction cable 10 is displaced without any change in the freely extended cable length, this leading to the entrainment elements 12 being moved in the same direction on the guide rails 11 and the window glass 13, on account thereof, being adjusted along the guide rails 11.

The power window actuator in the case of the exemplary embodiment according to FIG. 12 is disposed on an apparatus carrier 4 of a door module. The apparatus carrier 4 can, for example, be established on an internal door panel of a vehicle door and represents a pre-assembled unit which, in the pre-assembled state having the power window actuator disposed on the apparatus carrier 4, can be assembled on the vehicle door.

The drive device 1 of the exemplary embodiment according to FIGS. 1A, 1B to 9 is disposed on an area portion 40 of a carrier element 4 which is implemented, for example, by an apparatus carrier and which has a cable exit housing 2 disposed on a first side of the carrier element 4, and a drive housing 7 disposed on a second side of the carrier element 4, said second side facing away from the first side. The cable exit housing 2 serves for mounting the cable drum 3 on the carrier element 4, while the drive housing 7 encloses inter alia a drive wheel 6 which can be driven by way of a motor unit 8 and is connected to the cable drum 3 such that the cable drum 3 can be driven by rotating the drive wheel 6.

The cable drum 3 on the first side of the carrier element 4, when disposed according to the intended use on a vehicle door of a vehicle, for example, is disposed in a wet space of the vehicle door. By contrast, the drive housing 7 is located in the dry space of the vehicle door. The separation between the wet space and the dry space is established by way of the carrier element 4, and the interface between the drive wheel 6 and the cable drum 3 is accordingly to be sealed in a moisture-proof manner such that no moisture can make its way from the wet space to the dry space.

The cable exit housing 2 has a base 20, a cylindrical bearing element 22 in the form of a bearing dome that projects centrally from the base 20, and housing portions 21 in the form of housing webs which extend so as to be parallel to the cylindrical bearing element 22 and are radially spaced apart from the bearing element 22. The cable drum 3 is rotatably mounted on the bearing element 22 and herein is enclosed by the cable exit housing 2 in such a manner that the cable drum 3 is held on the carrier element 4.

The cable drum 3 has a body 30 and, on the circumferential shell face of the body 30, has a cable channel 300 for receiving the traction cable 10, said cable channel 300 being molded in the body 30. The cable drum 3 by way of a ring gear 31 is inserted in an opening 41 of the carrier element 4 and is connected in a rotationally fixed manner to the drive wheel 6 such that a rotating movement of the drive wheel 6 leads to a rotating movement of the cable drum 3.

The drive housing 7 by way of an interposed sealing element 5 is attached to the other, second side of the carrier element 4 and has a housing case 70 having a bearing element 72 in the form of a cylindrical bearing dome which is configured centrally in said housing case 70 and which engages through an opening 62 of the drive wheel 6 and which in this way rotatably mounts the drive wheel 6. A worm housing 74 adjoins the housing case 70, a drive worm 81 which is connected in a rotationally fixed manner to a drive shaft 800 of an electric motor 80 of the motor unit 8 lying in said worm housing 74 and by way of a worm toothing meshing with an external toothing 600 of a body 60 of the drive wheel 6. The drive shaft 800, at the end thereof that faces away from the electric motor 80, by way of a bearing 82 is mounted in the worm housing 74. The electric motor 80 herein lies in a motor case 73 of the drive housing 7, said motor case 73 by way of a housing cover 75 being closed in relation to the outside.

The drive housing 7 moreover has an electronics housing 76 in which a circuit board 760 having control electronics disposed thereon is enclosed. The electronics housing 76 is closed in relation to the outside by way of a housing plate 761 having a plug connector 762 for the electrical connection of the electronics of the circuit board 760 disposed on said housing plate 761.

The drive wheel 6, so as to project axially from the body 60, has a connecting wheel 61 having an external toothing 610 molded thereon, said connecting wheel 61 engaging with the ring gear 31 of the cable drum 3 in such a manner that an internal toothing 310 of the ring gear 31 (cf. FIG. 1B, for example) connects in a meshing manner with the external toothing 610 of the connecting wheel 61. The drive wheel 6 and the cable drum 3 are in this way connected in a rotationally fixed manner to one another such that the cable drum 3 is rotatable on the carrier element 4 by driving the drive wheel 6.

In order for the drive device 1 to be assembled, the cable exit housing 2 is attached to the carrier element 4, on the one hand, and the drive housing 7 is attached to the carrier element 4, on the other hand. The fastening to the carrier element 4 is in this instance performed in that a fastening element 9 in the form of a screw element is inserted into an engagement opening 721 on the lower side of the drive housing 7 in such a manner that the fastening element 9 extends through an opening 720 in the bearing element 72 of the drive housing 7 (cf. FIG. 9) and engages centrally in an opening 221 within the bearing element 22 of the cable exit housing 2. The cable exit housing 2 and the drive housing 7 by way of the fastening element 9 are mutually axially braced on the bearing elements 22, 72 and are moreover established on the carrier element 4.

A thread for receiving the fastening element 9 can be molded within the opening 221 of the bearing element 22 of the cable exit housing 2. However, it is also conceivable and possible for the fastening element 9 to be screwed into the opening 221 in a self-tapping manner.

For assembly, the cable exit housing 2 is attached to the first side of the carrier element 4 such that the cable exit housing 2 encloses the cable drum 3 and holds the latter on the carrier element 4 as is illustrated in FIGS. 2 to 4A, 4B. The cable exit housing 2 herein, by way of the housing portions 21 thereof that are radially spaced apart from the bearing element 22, by way of base portions 210 comes to bear on a contact ring 45 which circumferentially surrounds an opening 41 in the carrier element 4.

Axially projecting positive-lock elements 42 in the form of web-shaped pins are configured on the contact structure 45, said positive-lock elements 42, when attaching the cable exit housing 2 to the carrier element 4, engaging with positive-lock openings 212 (cf. FIG. 4B) on the base portions 210 of the housing portions 21, and in this way achieving an anti-rotation safeguard about the rotation axis D between the cable exit housing 2 and the carrier element 4, said rotation axis D being defined by the bearing element 22.

The web-shaped positive-lock elements 42, when viewed along the circumferential direction about the bearing element, on the lateral edges thereof can extend in an oblique manner (at a minor angle) such that the housing portions 21 when plug-fitting the base portions 210 onto the positive-lock elements 42 are established on the positive-lock elements 42 so as to be free of play along the circumferential direction.

Figure 6:
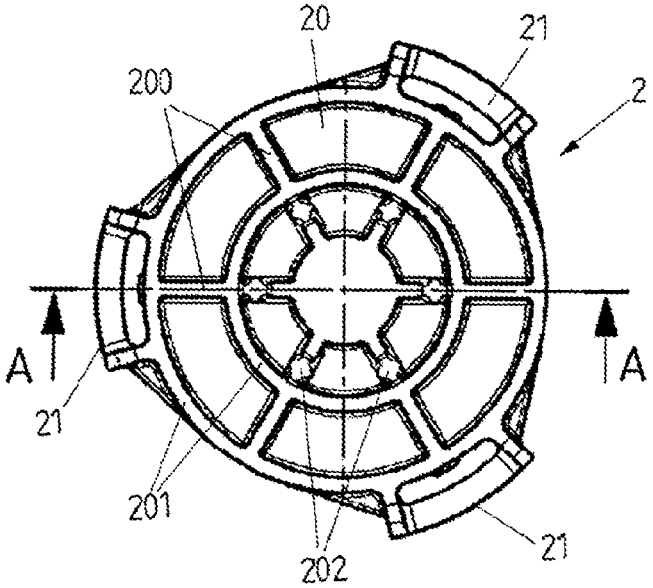
FIG. 6 shows a plan view of the cable exit housing.
Figure 7:
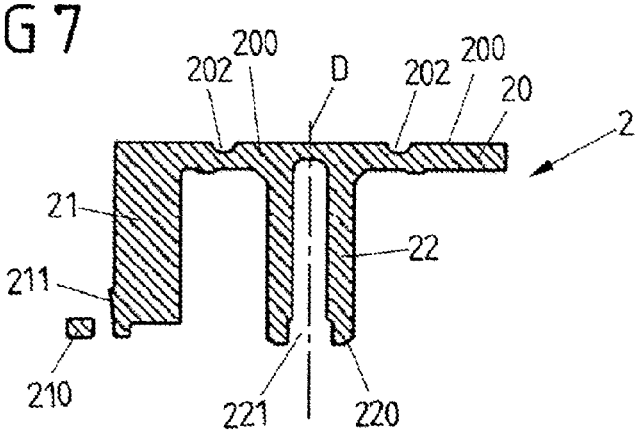
FIG. 7 shows a cross-sectional view along the line A-A according to FIG. 6.
Figure 8:
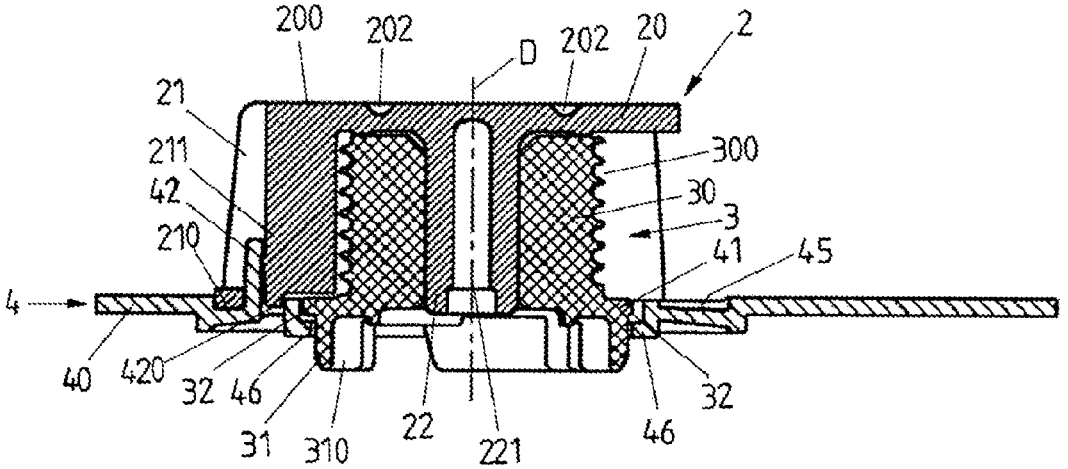
FIG. 8 shows the cross-sectional view according to FIG. 7, with the cable exit housing attached to the carrier element.

Latching clearances 420 (cf. FIG. 1A, for example) in which latching elements 211 in the form of outwardly projecting latching cams on the housing portions 21 engage in the case of an attached cable exit housing 2 are provided on the internal side of the positive-lock elements 42, as can be seen, for example, by comparing FIGS. 6 to 8. The cable exit housing 2, conjointly with the cable drum 3 enclosed therein, is held on the carrier element 4 in a pre-assembly position by way of said latching connection, even when the drive housing 7 is not yet braced in relation to the cable exit housing 2 by way of the fastening element 9. The latching connection thus simplifies the assembly and prevents the cable exit housing 2 from falling off in the case of an as yet unassembled drive housing 7.

The cable drum 3 in the pre-assembly position, by way of radially projecting bearing elements 32 on the upper periphery of the ring gear 31 (cf. FIG. 1A, for example) comes to bear on a bearing ring 46 within the opening 41 of the carrier element 4 (cf. FIG. 8, for example), such that the cable drum 3 in the pre-assembly position cannot slip through the opening 41 and is held on the carrier element 4 by way of the cable exit housing 2.

The bearing elements 32 serve in particular for securing the position of the cable drum 3 on the carrier element 4 in the pre-assembly position. Upon complete assembly of the drive device 1 the cable drum 3 is connected to the drive wheel 6 by way of the ring gear 31 and is axially established between the cable exit housing 2 and the drive housing 7.

Axially extending securing elements 23 that project in a radially inward manner are disposed on the internal sides of the housing portions 21, said securing elements 23 facing the cable channel 300 on the shell face of the body 30 and when in operation, sliding along said shell face. It is ensured by way of said securing elements 23 that the traction cable 10 received in the cable channel 300 cannot jump out of the cable channel 300.

Figure 1A:
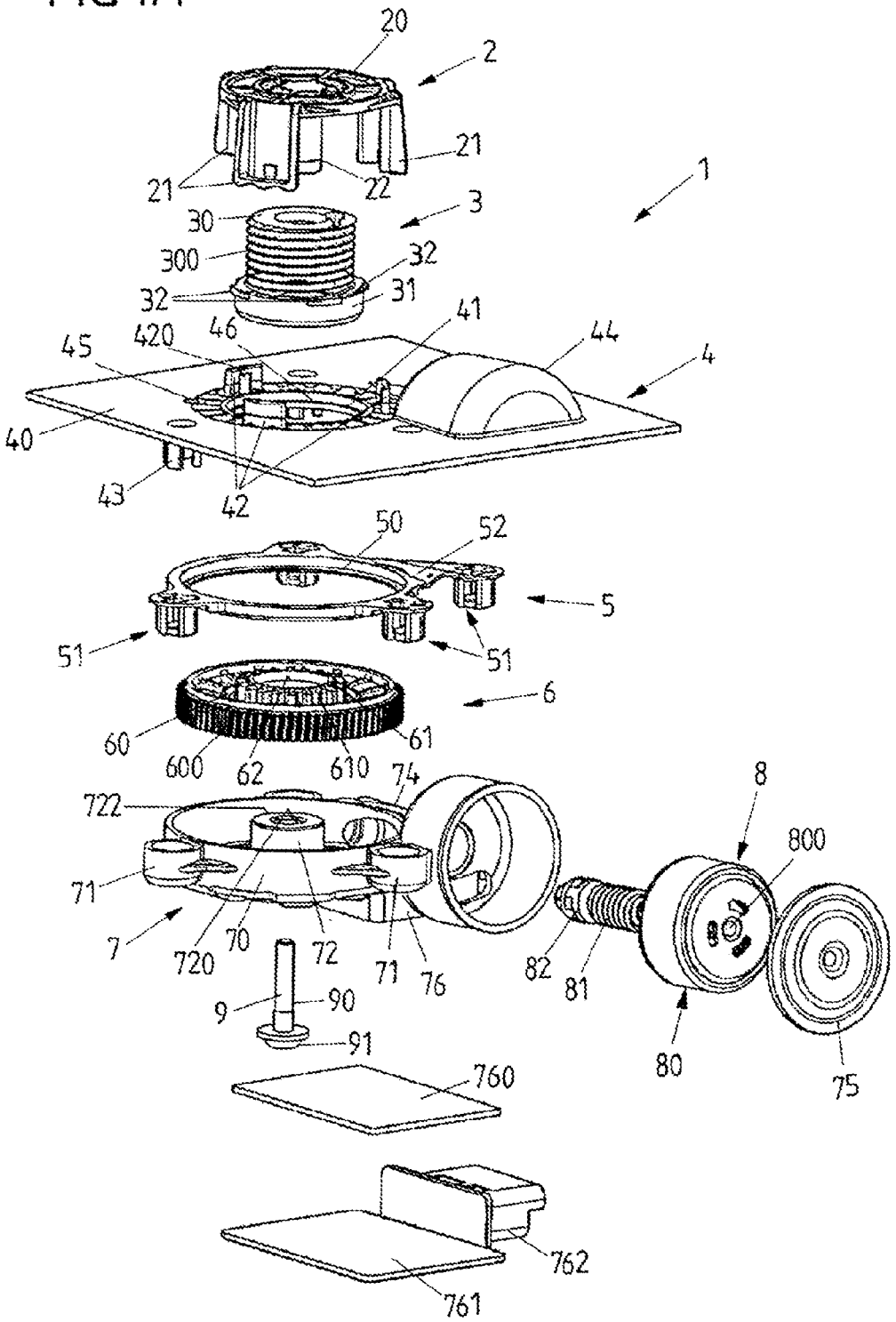
FIG. 1A shows an exploded view of an exemplary embodiment of a drive device.
Figure 1B:
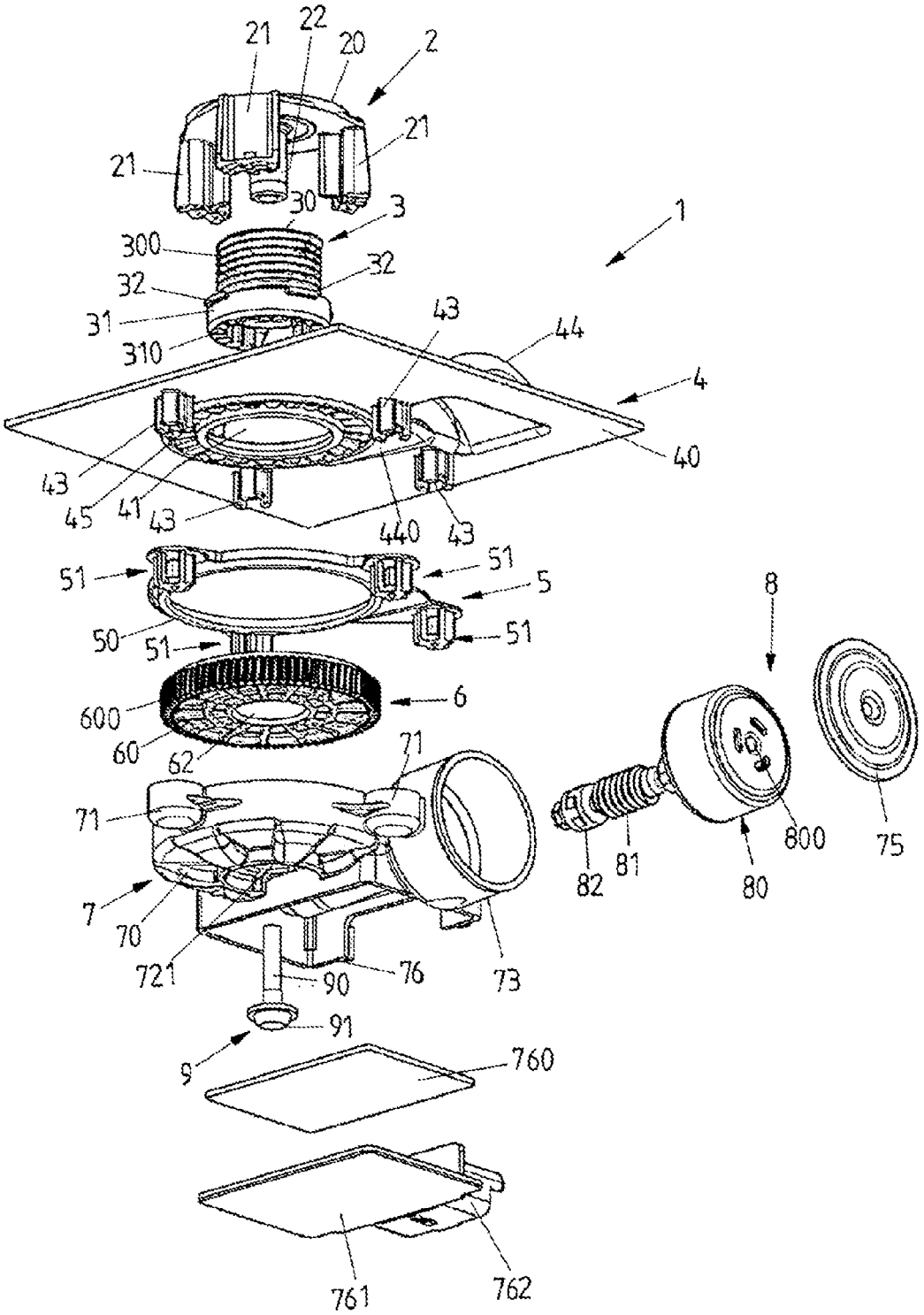
FIG. 1B shows the exploded view according to FIG. 1A from a different perspective.
Figure 2:
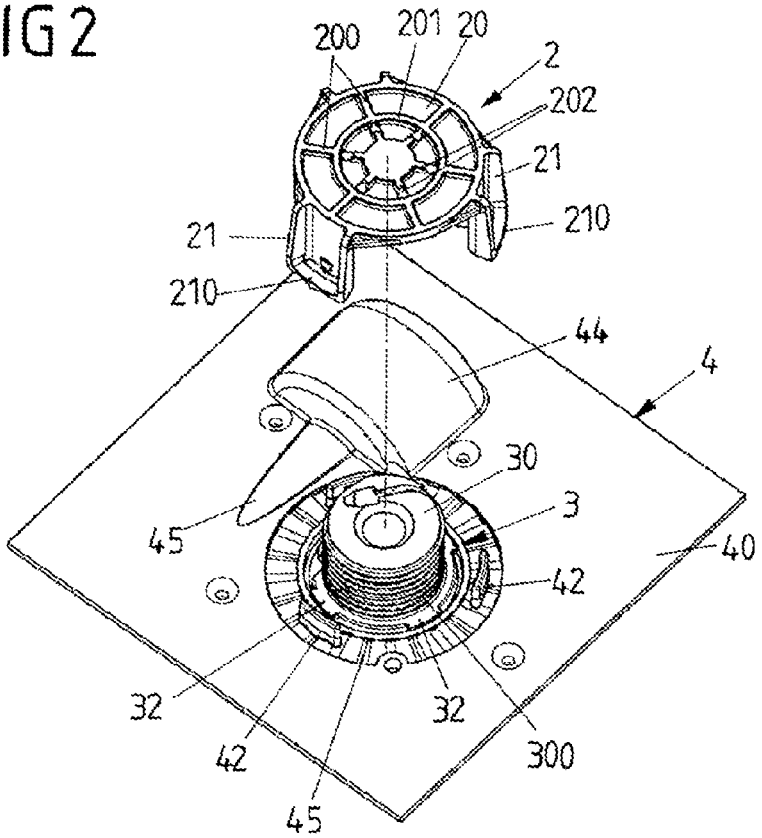
FIG. 2 shows a view of a cable exit housing before being attached to a carrier element.
Figure 3:
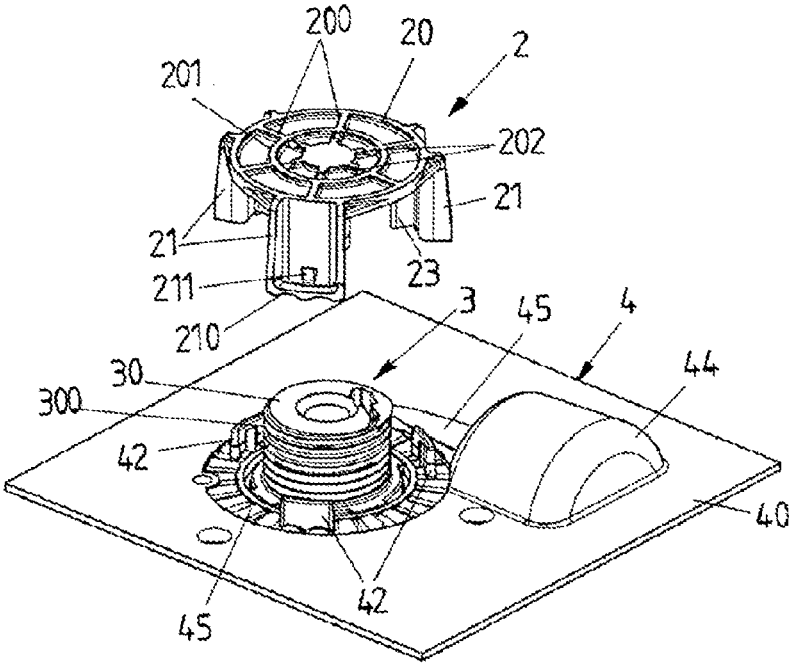
FIG. 3 shows another view of the cable exit housing before being attached to the carrier element.
Figure 4A:
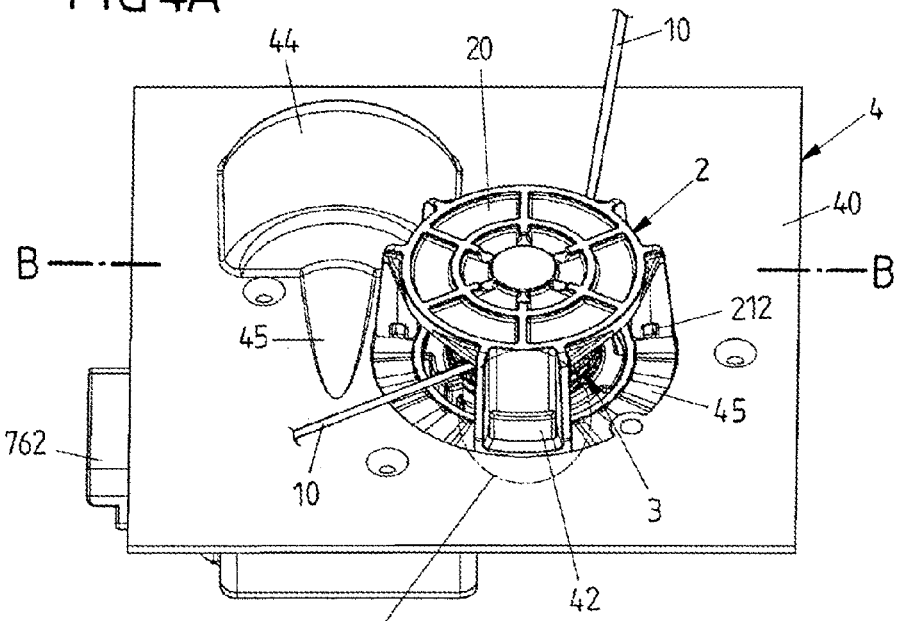
FIG. 4A shows a view of the cable exit housing on the carrier element.
Figure 4B:
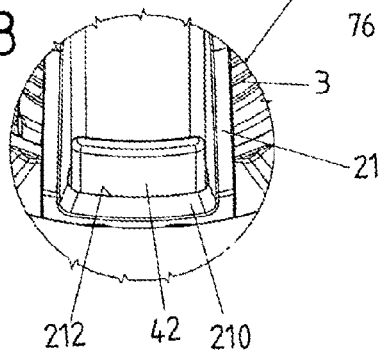
FIG. 4B shows a view enlarged in fragments of the assembly according to FIG. 4A.
Figure 5:
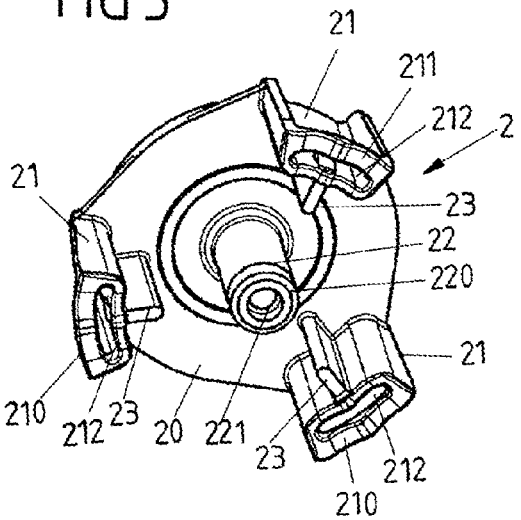
FIG. 5 shows a dedicated view of the cable exit housing seen from obliquely below.

The drive housing 7 is attached to the other, second side of the carrier element 4 in such a manner that the motor case 73 comes to lie in a molding 44 in the area portion 40, and the worm housing 74 comes to lie in a molding 440 in the area portion 40 that is adjacent to said molding 44 (cf. FIGS. 1A, 1B and 2). Fastening installations 71 in the form of engagement bushes having positive-lock openings 710 molded therein engage with positive-lock elements 43 in the form of pins projecting from the lower side of the carrier element 4 when the drive housing 7 is attached. On account of the positive-lock openings 710 of the fastening installations 71, exactly like the positive-lock elements 43 in the form of the pins on the carrier element 4, are radially spaced apart from the rotation axis D defined by the bearing element 72 of the drive housing 7, the drive housing on account of said positive-locking engagement is established in a rotationally fixed manner on the carrier element 4 such that an anti-rotation safeguard for the drive housing 7 is provided.

Engagement portions 51 are disposed on an annular seal 50 of the sealing element 5 on the positive-lock elements 43 of the carrier element 4, such that the positive-locking engagement of the positive-lock elements 43 in the positive-lock openings 710 on the fastening installations 71 is performed with the intervention of the engagement portions 51. This serves for the acoustic decoupling.

A curved portion 52 which comes to lie in the region of the molding 440 for receiving the worm housing 74 is configured on the sealing element 5. The curved portion 52 forms an intermediate layer between the worm housing 74 and the carrier element 4 such that an acoustic decoupling of the drive housing 7 from the carrier element 4 is achieved.

Figure 9:
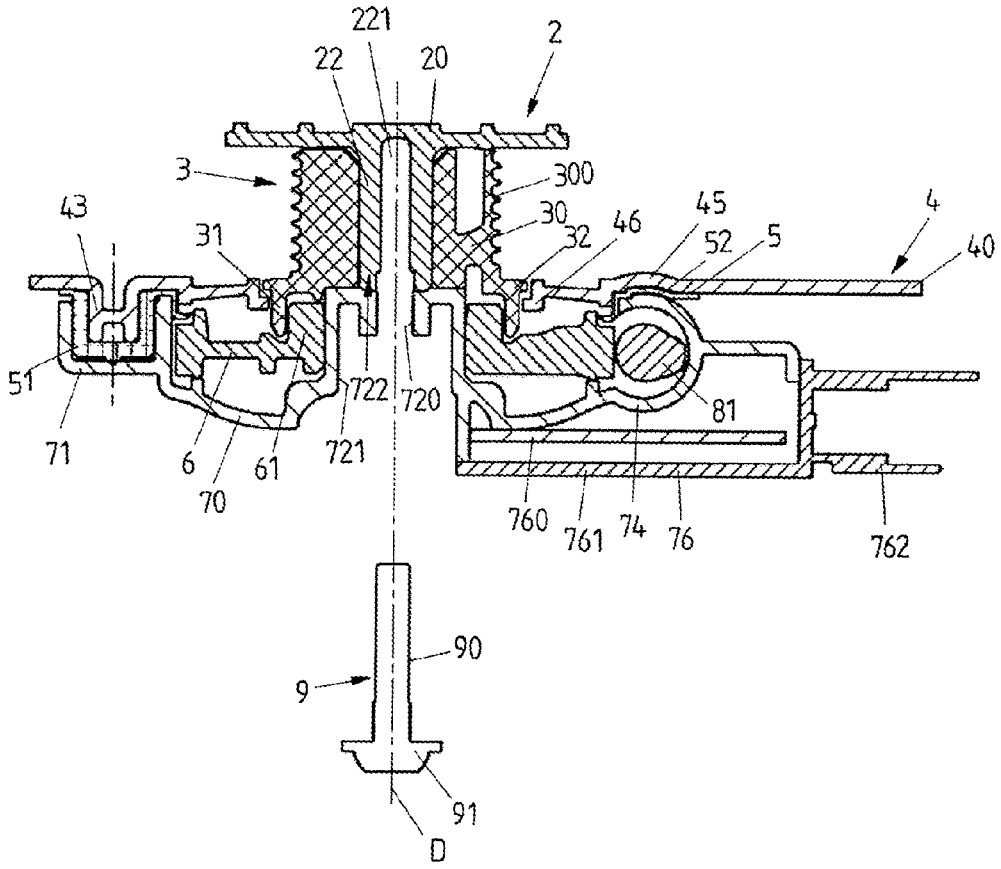
FIG. 9 shows a cross-sectional view along the line B-B according to FIG. 4A, before the bracing of the cable exit housing with a drive housing by way of a fastening element.

When the drive housing 7 has been attached to the carrier element 4 with the intervention of the sealing element 5, the drive housing 7 by way of the fastening element 9 is braced in relation to the cable exit housing 2 such that the cable exit housing 2 and the drive housing 7 thereby are mutually established and established on the carrier element 4. As is illustrated in FIG. 9, the fastening element 9 is inserted into the engagement opening 721 within the bearing element 72 of the drive housing 7 such that the fastening element 9 by way of a shank 90 engages through the opening 720 at the head of the bearing element 72 and engages in the opening 221 of the bearing element 22 of the cable exit housing 2. A head 91 of the fastening element 9 herein comes to lie on the side of the opening 720 that faces away from the bearing element 22 such that the cable exit housing 2 is braced in relation to the drive housing 7 by screwing the fastening element 9 into the opening 221 within the bearing element 22.

As can be seen from FIGS. 2 and 6, for example, the cable exit housing 2 on the base 20 thereof on the side that faces away from the carrier element 4 has structural elements 200, 201 in the form of reinforcement ribs which extend radially in relation to the rotation axis D defined by the bearing element 22, or extend circumferentially about the rotation axis D, and reinforce the base 20. Local recesses 202 for weakening the material on the structural elements 200 are achieved herein in the radially extending structural elements 200, said recesses 202 being disposed along a ring about the rotation axis D and achieving a predetermined breaking line for the elastic deformation of the base 20.

When the fastening element 9 is screwed into the bearing elements 22 from the side of the drive housing 7, the base 20 can thus be at least slightly deformed such that production-related tolerances can be equalized and the cable exit housing 2 by way of the base portions 210 on the housing portions 21 is established in a play-free manner on the carrier element 4.

The bearing element 22 on an end that faces away from the base 20 moreover has a conical portion 220 in the form of a centering cone (cf. FIGS. 8 and 9) which when bracing the cable exit housing 2 in relation to the drive housing 7 engages in a centering engagement, shaped in a complementary manner, on the bearing element 72 of the drive housing 7, and in this way sets a centered position of the bearing element 22 of the cable exit housing 2 in relation to the bearing element 72 of the drive housing 7. Both, the conical portion 220 on the end of the bearing element 22 as well as the centering engagement 722 on the head of the bearing element 72, are conically shaped and herein are mutually complementary (the conical portion 220 implements an external cone, while the centering engagement 722 represents an internal cone) such that the bearing element 22 of the cable exit housing 2 in the event of an engagement is aligned so as to be centered in relation to the bearing element 72 of the drive housing 7.

The bearing element 22 of the cable exit housing 2 and the bearing element 72 of the drive housing 7 herein define a common rotation axis D for the cable drum 3, on the one hand, and for the drive wheel 6, on the other hand, such that the cable drum 3 and the drive wheel 6 when in operation can rotate in a mutually coaxial and conjoint manner.

Figures 10A, 10B, 10C, 10D:
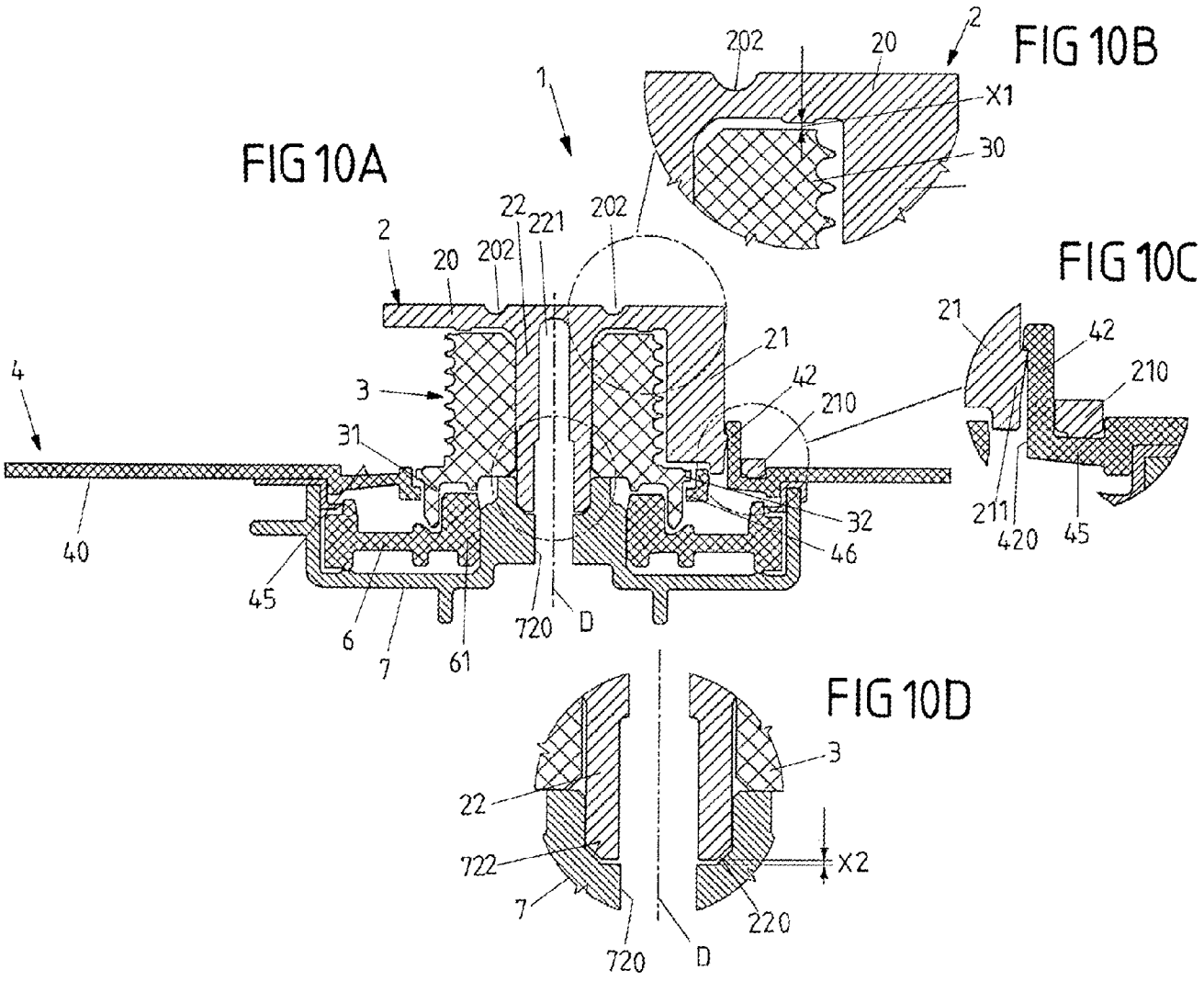
FIG. 10A shows a view of a further exemplary embodiment of a drive device in a cross-sectional view.
FIG. 10B shows an enlarged view in a first fragment according to FIG. 10A.
FIG. 10C shows an enlarged view in a second fragment according to FIG. 10A.
FIG. 10D shows an enlarged view in a third fragment according to FIG. 10A.

By contrast to the exemplary embodiment described above by means of FIGS. 1A, 1B to 9, the bearing element 22 in the case of an exemplary embodiment illustrated in FIGS. 10A to 10D and 11A to 11D is lengthened and by way of the end thereof engages in the bearing element 72 of the drive housing 7, such as can be seen, for example, from FIG. 10A and the enlarged view according to FIG. 10D.

FIGS. 10A to 10D herein show the drive device 1 in a first assembly position in which the cable exit housing 2, on the one hand, and the drive housing 7, on the other hand, are attached to the carrier element 4 but are not yet mutually braced by way of the fastening element 9. In this first assembly position, the cable exit housing 2 by way of the base portions 210 of the housing portions 21 thereof bear on the contact ring 45 of the carrier element 4 (cf. the enlarged view according to FIG. 10C), wherein a play X1 exists between the cable drum 3 and the base 20 (cf. the enlarged view according to FIG. 10B) and moreover a play X2 exists between the conical portion 220 on the end of the bearing element 22 and the centering engagement 722 on the bearing element 72 (cf. the enlarged view according to FIG. 10D).

Figures 11A, 11B, 11C, 11D:
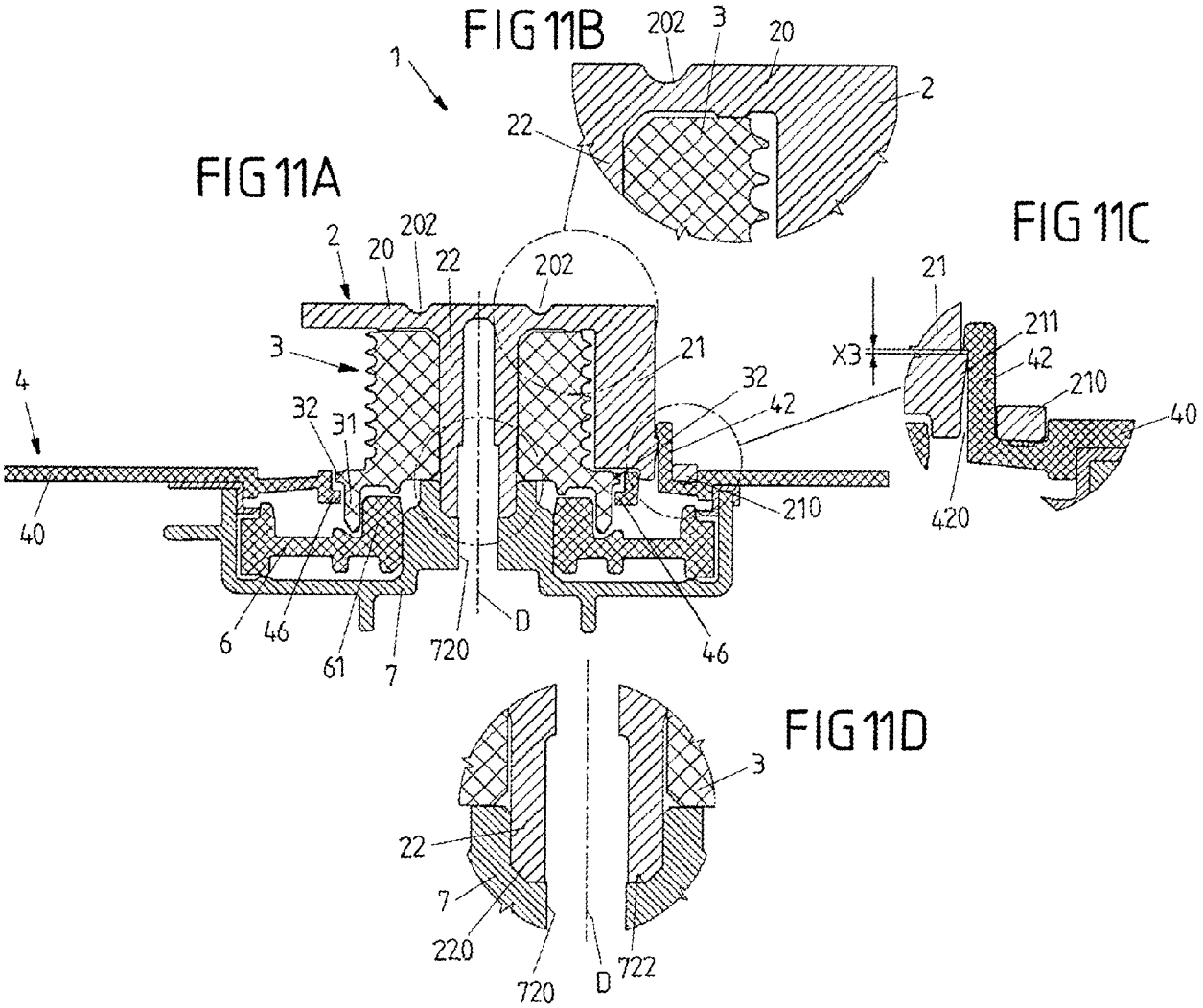
FIG. 11A shows the exemplary embodiment according to FIG. 10A in a braced state.
FIG. 11B shows an enlarged view of the assembly according to FIG. 11A in the first fragment.
FIG. 11C shows an enlarged view of the assembly according to FIG. 11A in the second fragment.
FIG. 11D shows an enlarged view of the assembly according to FIG. 11A in the third fragment.

When the cable exit housing 2 by way of the fastening element 9 is now braced axially in relation to the drive housing 7, the bearing element 22 on account thereof is drawn farther into the bearing element 72 and, on account thereof, the play X2 between the conical portion 220 of the bearing element 22 and the centering engagement 722 of the bearing element 72 is canceled, such as can be seen from the enlarged view according to FIG. 11B. This is performed while (slightly) deforming the base 20 of the cable exit housing 2, in particular at the predetermined breaking points 202, wherein the base portions 210 are also (slightly) deformed and, on account thereof, a play X3 is set in the axial direction between the latching element 211 of each housing portion 21 and the latching clearance 420 of the respective assigned positive-lock element 42 (FIG. 11C). Moreover, the play X1 between the base 20 and the cable drum 3 is largely canceled (cf. FIG. 11B) such that the cable drum 3 is held axially in a substantially play-free manner between the cable exit housing 2 and the bearing element 72 the drive housing 7, said cable drum 3 herein however being rotatable in a effortless manner on the bearing element 22.

The exemplary embodiment according to FIGS. 10A to 10D and 11A to 11D in functional terms is otherwise identical to the exemplary embodiment according to FIGS. 1A, 1B to 9, such that reference is to be made to the above.

An elimination of play as is the case in the exemplary embodiment according to FIGS. 10A to 10D and 11A to 11D by bracing the cable exit housing 2 in relation to the drive housing 7 can also be provided in the case of the exemplary embodiment according to FIGS. 1A, 1B to 9, such that the exemplary embodiments can also to this extent be functionally identical.

The concept on which the solution is based is not fundamentally limited to the exemplary embodiments set forth above but can fundamentally also be implemented in an entirely different manner.

A drive device of the type described is in particular not limited to the use in a power window actuator but can also serve for adjusting another adjustment element, for example a sliding roof or the like, in a vehicle.

The drive device can be assembled in a simple manner, in particular while using a (single) axially braced fastening element. An assembly which can be simple and cost-effective paired with a reliable establishment of the cable exit housing and of the drive housing on the carrier element results in few assembly steps.

LIST OF REFERENCE SIGNS

1 Drive device
10 Cable
11 Guide rail
110, 111 Deflection
12 Entrainment element
13 Window glass
2 Cable exit housing
20 Base
200, 201 Structural element (reinforcement rib)
202 Recess (material weakening)
21 Housing portion
210 Base portion
211 Latching element
212 Positive-lock opening (slot opening)
22 Bearing element (bearing dome)
220 Centering cone
221 Opening
23 Securing element
3 Cable drum
30 Body
300 Cable channel
31 Ring gear
310 Toothing
32 Bearing element
4 Carrier element (apparatus carrier)
40 Area portion
41 Opening
42 Positive-lock element
420 Latching clearance
43 Positive-lock element
44 Molding
440 Molding
45 Contact ring
46 Bearing ring
5 Sealing element
50 Annular seal
51 Engagement portion
52 Curved portion
6 Drive wheel
60 Body
600 External toothing
61 Connecting wheel
610 Toothing
62 Opening
7 Drive housing
70 Housing case
71 Fastening installation (engagement bush)
710 Positive-lock opening
72 Bearing element (bearing dome)
720 Opening
721 Engagement opening
722 Centering engagement
73 Motor case
74 Worm housing
75 Housing cover
76 Electronics housing
760 Circuit board
761 Housing plate
762 Plug connector
8 Motor unit
80 Electric motor
800 Drive shaft
81 Drive worm
82 Bearing
9 Fastening element
90 Shank
91 Head
D Rotation axis
X1, X2, X3 Play

The invention claimed is:

1. A drive device for use in an adjustment apparatus for adjusting a vehicle part, including a power window actuator, the drive device comprising:

a carrier element;

a cable drum;

a cable exit housing disposed on a first side of the carrier element and which has a first bearing element for mounting the cable drum so as to be rotatable about a first rotational axis;

a drive wheel that is drivable by a motor unit; and a drive housing which is disposed on a second side, facing away from the first side, of the carrier element and which has a second bearing element for mounting the drive wheel so as to be rotatable about a second rotational axis, wherein the cable exit housing and the drive housing are fastened to one another by way of a fastening element which acts between the first bearing element and the second bearing element, wherein one of the first bearing element and the second bearing element comprises a conical portion, and the other of the first bearing element and the second bearing element comprises a centering engagement portion for interacting with the conical portion in order to center the first bearing element and the second bearing element with respect to one another, wherein in a first assembly position, in which the cable exit housing and the drive housing are disposed on the carrier element but are not yet mutually axially braced by way of the fastening element, the conical portion and the centering engagement portion have mutual axial play; and in a second assembly position in which the cable exit housing and the drive housing are mutually axially braced by way of the fastening element, the conical portion and the centering engagement portion bear on one another, wherein the cable exit housing in at least one portion is elastically deformable when bracing the cable exit housing and the drive housing with respect to one another using the fastening element.

2. The drive device as claimed in claim 1, wherein the first rotational axis and the second rotational axis are disposed so as to be mutually coaxial.

3. The drive device as claimed in claim 1, wherein the fastening element is a screw element which mutually braces the cable exit housing and the drive housing with respect to one another.

4. The drive device as claimed in claim 1, wherein the fastening element extends through an opening of one of the first bearing element and the second bearing element and is connected with the other of the first bearing element and the second bearing element.

5. The drive device as claimed in claim 1, wherein the cable exit housing has a base from which the first bearing element projects, wherein the base, when bracing the cable exit housing in relation to the drive housing, is elastically deformable.

6. The drive device as claimed in claim 5, wherein the base has at least one reinforcing structural element in which a rigidity-weakening recess for providing a predetermined breaking point is formed in at least one location.

7. The drive device as claimed in claim 6, wherein the at least one structural element is formed by a reinforcement rib.

8. The drive device as claimed in claim 1, wherein the cable exit housing has at least one housing portion which is radially spaced apart from the first bearing element and which is established on the carrier element in such a manner that the cable exit housing is held on the carrier element so as to be rotationally fixed in relation to the first rotational axis.

9. The drive device as claimed in claim 8, wherein the housing portion has a base portion which is attached to the carrier element, wherein one of the base portion and the carrier element comprises a positive-lock element a positive-locking, and the other of the base portion and the carrier element comprises manner in a positive-lock opening, the positive-lock element engaging the positive-lock opening.

10. The drive device as claimed in claim 1, wherein the drive housing has at least one fastening device which is radially spaced apart from the second bearing element and by way of which the drive housing is fastened to the carrier element in such a manner that the drive housing is held on the carrier element so as to be rotationally fixed in relation to the second rotational axis.

11. The drive device as claimed in claim 10, wherein one of the base portion and the fastening device comprises a positive-lock element and the other of the base portion and the fastening device comprises a positive-lock opening, the positive-lock element engaging with the positive lock opening.

* * * * *